United States Patent [19]

Sainen et al.

[11] Patent Number: 4,513,790

[45] Date of Patent: Apr. 30, 1985

[54] METHOD AND APPARATUS FOR CONTROLLING MOTOR-DRIVEN LET-OFF MOTION FOR LOOMS

[75] Inventors: Tsutomu Sainen; Toshiyuki Sakano; Yoshitaka Fujita, all of Kanazawa; Toshiki Imai, Matsuto, all of Japan

[73] Assignee: Tsudakoma Corp., Kanazawa, Japan

[21] Appl. No.: 579,248

[22] Filed: Feb. 13, 1984

[30] Foreign Application Priority Data

Feb. 25, 1983 [JP] Japan ..... 58-31451

[51] Int. Cl.[3] ..... D03D 49/10

[52] U.S. Cl. ..... 139/110; 242/75.44; 242/75.51

[58] Field of Search ..... 139/110, 103, 105, 108, 139/109; 242/75.42, 75.43, 75.44, 75.45, 75.47, 75.51

[56] References Cited

U.S. PATENT DOCUMENTS

| | | | |
|---|---|---|---|
| 3,878,872 | 4/1975 | Hintsch | 139/311 |
| 4,151,594 | 4/1979 | Stern | 242/75.44 |
| 4,199,118 | 4/1980 | Tetro | 242/75.44 |
| 4,407,331 | 10/1983 | Rehling | 242/75.51 |
| 4,407,462 | 10/1983 | Tajima | 242/75.47 |

FOREIGN PATENT DOCUMENTS

| | | | |
|---|---|---|---|
| 629549 | 4/1982 | Switzerland | 139/110 |

*Primary Examiner*—Henry S. Jaudon
*Assistant Examiner*—S. Shongut
*Attorney, Agent, or Firm*—Flynn, Thiel, Boutell & Tanis

[57] ABSTRACT

A method of controlling a motor-driven let-off motion in a loom including a system for controlling a let-off motion motor includes the steps of sampling a variation of warp tension during each revolution of a main shaft of the loom, effecting at least proportional and integral control modes on the average of sampled values, adding a proportional and integral output to a basic speed signal at a prescribed ratio, and applying a sum signal to the system for controlling the let-off motion motor. An apparatus for controlling a motor-driven let-off motion in a loom including a system for controlling a let-off motion motor includes an average computing unit for computing the average of warp tension variations detected at a plurality of sampling times while a main shaft of the loom revolves, a control unit for effecting at least a proportional and integral computation on the average to produce a proportional and integral output, a basic speed computing unit responsive to information indicative of the number of RPM of the main shaft of the loom, the diameter of warp coils on beams, and the number of beatings for computing a basic speed, and a speed command computing unit responsive to the proportional and integral output and the basic speed for adding the proportional and integral output to the basic speed at a prescribed ratio to generate a speed command signal and for applying the speed command signal to the system for controlling the let-off motion motor. With this arrangement, there is no time-delay element in the control system and hence any tension variations can be detected quickly. When the loom is stopped in operation, the integral of a warp tension prior to the stoppage of the loom is stored. When the loom is restarted, the stored integral is issued to suppress any unwanted tension variations of the warp yarns. Since a tension compensation gain is not relatively varied when the diameter of a warp coil is changed, the control system can provide ideal control characteristics.

6 Claims, 4 Drawing Figures

METHOD AND APPARATUS FOR CONTROLLING MOTOR-DRIVEN LET-OFF MOTION FOR LOOMS

BACKGROUND OF THE INVENTION

1. Field of the Invention

The present invention relates to a method of and an apparatus for controlling a motor-driven let-off motion for use in a loom.

2. Description of the Prior Art

Control systems for controlling motor-driven let-off motions for looms have a tension compensator for detecting any variation in the tension of warp yarns during weaving to compensate for deviations or errors in the control system.

The tension of warp yarns is subjected to ripples due to major motions of the loom while the main shaft of a loom makes one revolution. Such tension ripples during one revolution of the main shaft are not usually placed under control. The tension compensator includes an integrating circuit having a large time constant to provide an integrating capability for taking up the tension ripples while the main shaft makes one revolution. The integrating capability however makes the conventional control system slow in detecting warp tension. As the diameter of warp coils on beams is reduced as the weaving progresses while the loom is in operation, a tension compensation gain is relatively changed so that optimum control cannot be achieved. Since an integrating capacitor is discharged when the weaving is interrupted, the operating condition prior to the interruption of the weaving cannot be reached when the loom is restarted, resulting in poor restarting characteristics.

SUMMARY OF THE INVENTION

It is a first object of the present invention to increase the detection speed of a control system for achieving optimum tension compensation control in relation to a warp coil diameter.

A second object of the present invention is to suppress varying restarting characteristics.

According to the present invention, rippled variations in the tension of warp yarns are sampled each time the main shaft of a loom makes one revolution, and a composite PI (proportional-integral) control mode is effected on the average of the sampled values. While the loom is at rest, the integrated values of the sampled tensions in the PI control mode are stored in preparation for achieving stable characteristics when the loom is to be set in motion again. A PI output is kept at a certain ratio with respect to a fundamental speed for ideal tension compensation.

Since the PI control mode is effected on the average of the sampled valued, no time delay element is introduced and hence tension variations can quickly be detected. Because the PI output is applied to the fundamental speed at a certain ratio thereto, a tension compensation gain will not be relatively varied even when the diameter of warp coils is reduced, with the result that ideal tension control can be accomplished. As the integral value in the PI control mode is stored, the loom can be restarted under the same condition as that prior to an interruption of operation of the loom. This can suppress warp tension variations as much as possible at an initial stage of the loom restarting.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
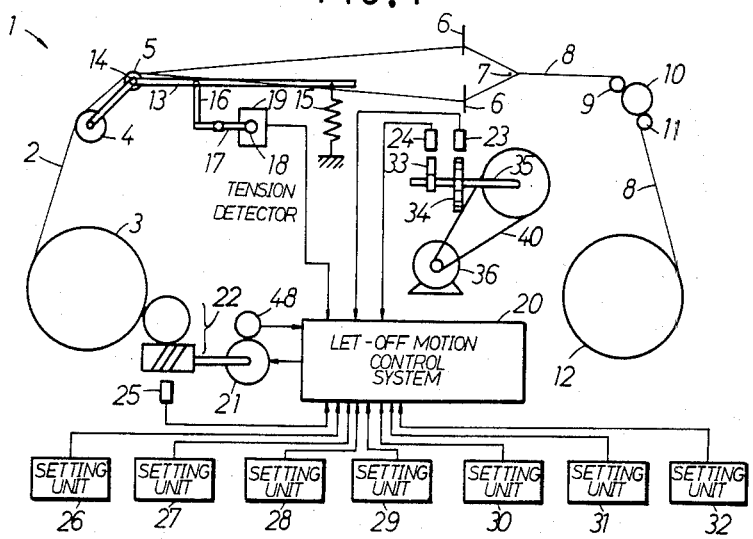
FIG. 1 is a schematic side elevational view of a motor-driven let-off motion in a loom with a control system of the present invention being shown in block form.

FIG. 1 schematically shows a motor-driven let-off motion in a loom according to the present invention. Warp yarns 2 to be controlled are coiled on a feeding beam 3 and fed warpwise through a tensioning roll 4 and a guide roll 5. The warp yarns 2 are then selectively separated into upper and lower groups to form a warp shed in response to selective vertical movement of healds 6. The warp yarns 2 are woven with a weft yarn 7 into a fabric 8, which is then delivered through a guide roll 9, a takeup roll 10, and a guide roll 11 and finally wound around a takeup beam 12.

The tensioning roller 4 is rotatably supported on an end of a tensioning lever 13 swingably mounted on a shaft 14 on which the guide roller 5 is rotatably mounted. The tensioning lever 13 is normally urged to turn clockwise about the shaft 14 by a tension spring 15 acting on the other end of the tensioning lever 13. Any swinging movement of the tensioning lever 13 is transmitted through a connecting rod 16 as synchronized swinging movement to a detecting lever 17. The detecting lever 17 supports on a distal end thereof a body 18 to be detected by a tension detector 19 out of contact therewith.

The feeding beam 3 is drivable by a let-off motion motor 21 controlled by a let-off motion control system 20 and a speed reducer 22 operatively coupled with the motor 21. The let-off motion control system 20, which is provided according to the present invention, effects necessary control in response to input signals from the tension detector 19, a proximity switch 23 which detects a signal each time a main or crank shaft 35 of the loom turns through a certain angle, 10 degrees for example, a proximity switch 24 which detects a signal indicative of a reference angular position, 0-degree position for example, of the crank shaft 35, a proximity switch 25 which detects a speed reducer gear rotation signal, a setting unit 26 for setting a number B of occurences of weft beating, a setting unit 27 for setting an initial warp coil diameter Ro, a setting unit 28 for setting an RPM no, a setting unit 29 for setting a repetitive number r, a setting unit 30 for setting a proportional gain Kp, a setting unit 31 for setting an integral time Ti, and a setting unit 32, for setting a derivative time Td. The proximity switches 24, 23 are disposed ajacent to rotors 33, 34, respectively, mounted on the crank shaft 35, which is driven by a main motor 36 through a transmission mechanism 40.

Figure 2:
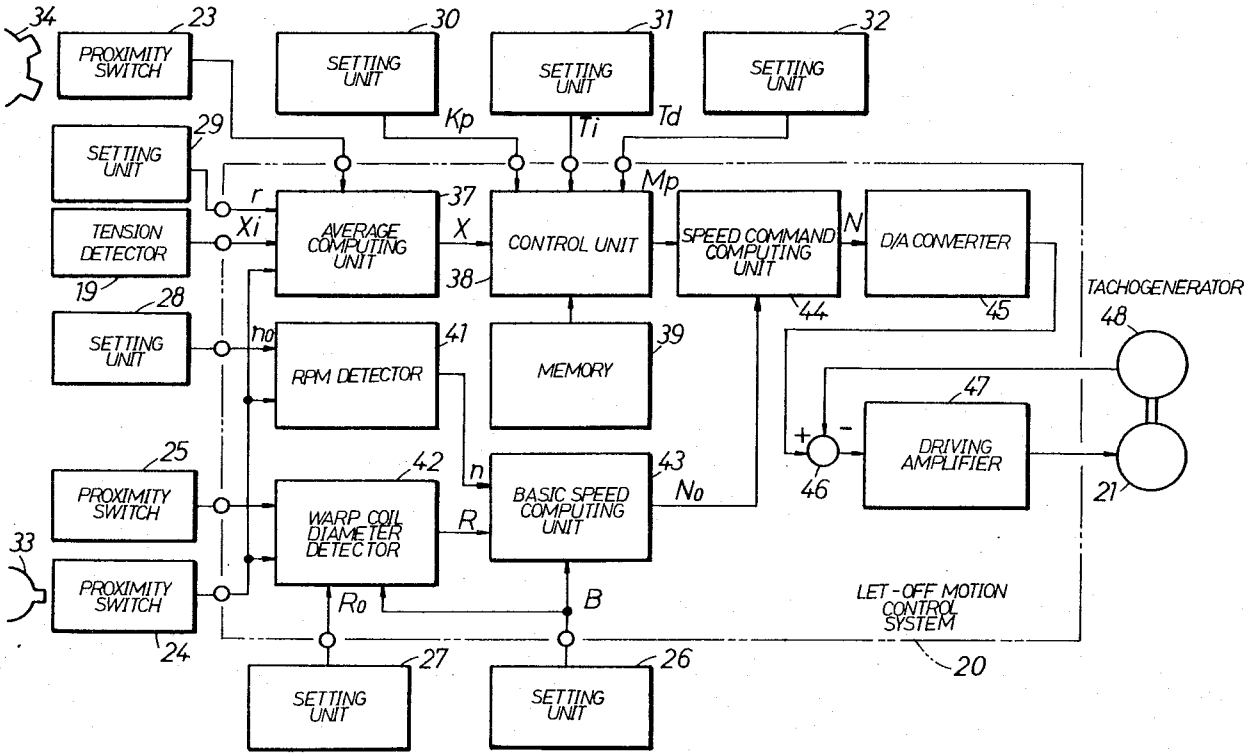
FIG. 2 is a block diagram of the control system for the motor-driven let-off motion shown in FIG. 1.

FIG. 2 shows the let-off motion control system 20 in block form. The let-off motion control system 20 includes an average computing unit 37 supplied with a signal issued from the proximity switch 23 each time the crank shaft 35 turns through a certain angle, a set repetitive number r, and tension signals Xi (i=1, 2, . . . 36r) detected by the tension detector 19 for computing an average tension value X and delivering the average tension value X to, for example, a PID (proportional-integral-derivative) type control unit 38. The average tension value X can be determined by the following equation:

$$X = \frac{1}{36r} \sum_{i=1}^{36r} Xi \tag{1}$$

The PID control unit 38 is responsive to the proportional gain Kp, the integral time Ti, and the derivative time Td, as required, from the setting units 30, 31, 32 for effecting a combined proportional (P), integral (I), and derivative (D), as required, control mode to issue a PID output Mp, which is expressed by:

$$Mp = Kp\left[X(k) + \frac{1}{Ti}\sum_{m=0}^{K} X(m) + Td\{X(k) - X(k-1)\}\right] \tag{2}$$

The term Td {X(k)−X(k−1)} in the above equation is indicative of a derivative value. Since the derivative action is effected only when required, the PID output Mp may not contain such a derivative value. Accordingly, the control unit 38 should be provided with at least proportional and integral control capabilities. The value ΣX(m) is an integral stored in a memory 39 connected to the control unit 38. More specifically, when the loom is set in motion again after it has been interrupted in operation, the memory 39 issues the stored integral ΣX (m) through the PID control unit 38 to a speed command computing unit 44 for stabilizing characteristics at the time the loom is started again. An RPM detector 41 is responsive to a signal indicative of an RPM no for detecting an RPM n and issuing information representative of the RPM n to a basic speed computing unit 43. A warp coil diameter detector 42 is responsive to a signal indicating an initial warp coil diameter Ro, a signal indicating a weft beating number B, and a speed reducer gear rotation signal from the proximity switch 25 each time the crank shaft 35 reaches its reference angular position for detecting a coil diameter R of the warp yarns 2 on the feeding beam 3. The coil diameter R is expressed by the following equation:

$$R = \frac{5M1}{\pi} \cdot \frac{1}{B} \cdot \frac{PL}{Pw} \tag{3}$$

where

M1: the ratio of speed reduction from the speed reducer gear to the beam;

Pw: the number of gear rotation pulses; and

PL: the number of crank shaft rotation pulses.

The basic speed computing unit 43 is supplied with pieces of information on the RPM n, the coil diameter R, and the weft beating number B to compute a basic speed No which is expressed as follows:

$$N0 = \frac{5M}{\pi} \cdot \frac{n}{B} \cdot \frac{1}{R} \tag{4}$$

where M is the ratio of speed reduction from the feeding motor 21 to the feeding beam 3. An output signal indicative of the basic speed No is then fed from the basic computing unit 43 to the speed command computing unit 44. The speed command computing unit 44 adds the signal of the PID output Mp to the basic speed No at a certain ratio thereto to generate a speed command signal N which is then applied to a D/A converter 45 in a motor control system. Assuming that the ratio of the speed command signal N to the signal of the basic speed No is 1/100, the speed command signal N is given by the following equation:

$$N = No\left(1 + \frac{Mp}{100}\right) \tag{5}$$

The D/A converter 45 converts the digital speed command signal N into an analog signal and supplies the latter through an adding point 46 to a driving amplifier 47 in the motor control system. The driving amplifier 47 is based on the speed command signal N for controlling the speed of rotation of the motor 21. The speed of rotation of the motor 21 is detected by a tachogenerator 48 which applies a signal proportional to the detected rotational speed to the adding point 46 through a negative feedback loop. The motor 21 is thus controlled by the negative feedback loop to keep a target rotational speed for controlling the speed of rotation of the feeding beam 3.

The average computing unit 37 computes an average tension each time the crank shaft 35 turns through a certain angle, and has no integrating circuit having a large time constant for detecting tension variations. Accordingly, the control system of the invention can detect tension variations more quickly than can conventional control systems for warp tension. The control unit 38 effects the PID arithmeic operation on the average value X and holds the PID output for a sampling period, with the integral in the PID output being stored in the memory 39. Therefore, when the loom is set in motion again after it has been stopped, the PID output Mp from the control unit 38 is composed of a proportional output plus an integral, which is a value prior to the stoppage of the loom. The loom consequently resumes it operation quickly at the rotational speed prior to the interruption of its operation and approaches a target speed. As a result, tension variations of the warp yarns can be held to a minimum at the time the loom is set in motion again. Since the speed command computing unit 44 adds the PID output Mp to the signal of basic speed No inversely proportional to the coil diameter R at a certain ratio to the basic speed No, a tension compensation gain is not relatively varied when the coil diameter is changed.

The arrangement of the foregoing embodiment is not aimed at controlling warp tension variations during one revolution of the crank shaft of the loom. The warp tension is subjected to large variations due to major motions of the loom such as shedding and beating. If the warp yarns were not tensioned properly dependent on the crank angle at the time of restarting the loom, no appropriate tension setting is possible for the warp yarns and a resultant fabric would become poor in quality. Such a difficulty can effectively be eliminated by computing tension averages and their integrals at respective sampling angles while the crank shaft of the loom makes successive revolutions and storing the tension averages and integrals at respective addresses in the memory 39 which correspond to the sampling angles.

Such a control mode can easily be performed by employing a controlling function available in a CPU. Since the above control mode is effected at a high accuracy, it is advantageous for weaving fine fabrics.

The warp tension has conventionally been detected by directly measuring a bundle of several tens of warp yarns 2 with a tensometer. However, such measurement suffers from large measuring errors because of large tension variations due to shedding and beating operations of the loom. A special measuring device is necessary for comparing measured values with crank angles. Correct tension setting for fabrics needs an increased expenditure of time and labor, and is presently effected mostly on the skill and experience of the operator.

Figure 3:
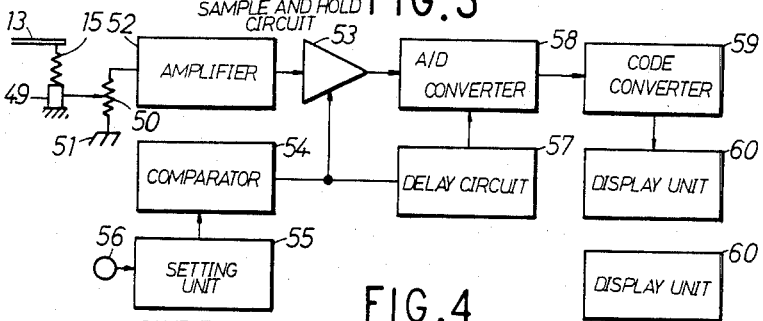
FIGS. 3 and 4 are block diagrams of tension display devices according to different embodiments of the present invention.
Figure 4:
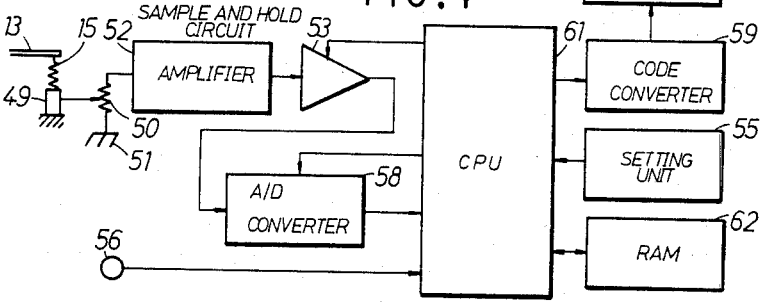

FIGS. 3 and 4 show systems for detecting and displaying a warp tension each time the crank shaft turns through a certain angle. According to the arrangement shown in FIG. 3, the tension of warp yarns 2 is detected by a load cell 49 which issues a signal that is converted into a signal of an appropriate level by a variable resistor 50 connected to ground 51. Then, the signal is fed through an amplifier 52 to a sample and hold circuit 53. A comparator 54 compares an angle setting from a setting unit 55 with a rotation angle of the crank shaft of a loom as detected by a rotation detector 56. When the compared angles coincide with each other, the comparator 54 energizes the sample and hold circuit 53 to hold the tension signal and causes a delay circuit 57 to energizes an A/D converter 58. The A/D converter 58 converts an analog signal from the sample and hold circuit 53 into a digital signal and applies the latter to a code converter 59. The code converter 59 converts the applied signal into a BCD code signal which is then fed to a display unit 60. The display unit 60 now displays the tension of the warp yarns 2 at the angle setting directly in a numerical representation.

FIG. 4 shows an arrangement including a CPU 61 and a RAM 62 for comparing an angle setting and a rotation angle and controlling the sample and hold circuit 53 and the A/D converter 58. The CPU 61 serves to effect a series of controlling operations, store the tension values corresponding to the rotation angles in the RAM 62, and successively read the stored tension values from the RAM 62 to deliver the same through the code converter 59 to the display unit 60. The CPU 61 is also used to control the RAM 62 to store average tensions and their integrals at respective rotation angles while the crank shaft of the loom makes successive revolutions.

With the arrangement of the present invention, there is no time-delay element in the control system and hence any tension variations can be detected quickly. When the loom is stopped in operation, the integral of a warp tension prior to the stoppage of the loom is stored. When the loom is restarted, the stored integral is issued to suppress any unwanted tension variations of the warp yarns. Since a tension compensation gain is not relatively varied when the diameter of a warp coil is changed, the control system can provide ideal control characteristics.

Although certain preferred embodiments have been shown and described, it should be understood that many changes and modifications may be made therein without departing from the scope of the appended claims.

What is claimed is:

1. A method of controlling a motor-driven let-off motion in a loom including a system for controlling a let-off motion motor, comprising the steps of:

(a) sampling a variation of warp tension during each revolution of a main shaft of the loom;

(b) effecting at least proportional and integral control modes on the average of sampled values;

(c) adding a proportional and integral output to a basic speed signal at a prescribed ratio; and (d) applying a sum signal to the system for controlling the let-off motion motor.

2. A method according to claim 1, further including the steps of:

(a) periodically storing an integral produced in said proportional and integral control modes;

(b) reading the stored integral when the loom is to be restarted after it has been stopped; and (c) applying the read integral to said system.

3. A method of controlling a motor-driven let-off motion in a loom including a system for controlling a let-off motion motor, comprising the steps of:

(a) sampling a variation of warp tension during each revolution of a main shaft of the loom and a variation of warp tension each time the main shaft is turned through a given rotational angle during one revolution of said main shaft;

(b) effecting at least proportional and integral control modes on the average of sampled values;

(c) adding a proportional and integral output to a basic speed signal at a prescribed ratio;

(d) applying a sum signal to the system for controlling the let-off motion motor;

(e) periodically storing an integral produced in said proportional and integral control modes;

(f) reading the stored integral when the loom is to be restarted after it has been stopped; and (g) applying the read integral to said system.

4. An apparatus for controlling a motor-driven let-off motion in a loom including a system for controlling a let-off motion motor, comprising:

(a) an average computing unit for computing the average of warp tension variations detected at a plurality of sampling times while a main shaft of the loom revolves;

(b) a control unit for effecting at least a proportional and integral computation on said average to produce a proportional and integral output;

(c) a basic speed computing unit responsive to information indicative of the number of RPM of the main shaft of the loom, the diameter of warp coils on beams, and the number of beatings for computing a basic speed; and (d) a speed command computing unit responsive to said proportional and integral output and said basic speed for adding said proportional and integral output to said basic speed at a prescribed ratio to generate a speed command signal and for applying said speed command signal to the system for controlling the let-off motion motor.

5. An apparatus for controlling a motor-driven let-off motion in a loom including a system for controlling a let-off motion motor, comprising:

(a) an average computing unit for computing the average of warp tension variations detected at a plurality of sampling times while a main shaft of the loom revolves;

(b) a control unit for effecting at least a proportional and integral computation on said average to produce a proportional and integral output;

(c) a memory for storing an integral in the proportional and integral output during a period in which the loom stops:

(d) a basic speed computing unit responsive to information indicative of the number of RPM of the main shaft of the loom, the diameter of warp coils on beams, and the number of beatings for computing a basic speed; and (e) a speed command computing unit responsive to said proportional and integral output and said basic speed for adding said proportional and integral output to said basic speed at a prescribed ratio to generate a speed command signal and for applying said speed command signal to the system for controlling the let-off motion motor.

6. An apparatus according to claim 5, wherein said average computing unit computes the average of warp tension variations for successive rotational angles of the main shaft during one revolution of said main shaft, and said memory stores the integral in the proportional and integral output for each of the successive rotational angles of the main shaft during one revolution of said main shaft.

* * * * *